United States Patent [19]

Donohue

[11] Patent Number: 4,862,857

[45] Date of Patent: Sep. 5, 1989

[54] FUEL INJECTION SYSTEM FOR MULTI CYLINDER TWO-STROKE ENGINE

[75] Inventor: James A. Donohue, Pewaukee, Wis.

[73] Assignee: Outboard Marine Corporation, Waukegan, Ill.

[21] Appl. No.: 155,561

[22] Filed: Feb. 12, 1988

[51] Int. Cl.[4] ..... F02B 13/10; F02M 51/00

[52] U.S. Cl. ..... 123/534; 123/73 CB; 123/59 BM

[58] Field of Search ..... 123/59 B, 59 BM, 59 EC, 123/73 C, 73 CB, 531, 534

[56] References Cited

U.S. PATENT DOCUMENTS

| | | | |
|---|---|---|---|
| 1,394,850 | 10/1921 | Long | 123/59 B |
| 1,860,784 | 5/1932 | Nelson | 123/532 |
| 1,921,510 | 8/1933 | DeWasmundt | 123/73 C |
| 2,164,234 | 6/1939 | Erren | 123/73 CB |
| 2,246,019 | 6/1941 | Steinlein | 123/73 CB |
| 2,528,263 | 10/1950 | Chapman | 123/265 |
| 4,033,302 | 7/1977 | Jarnuszkiewicz | 123/59 BM |
| 4,131,090 | 12/1978 | Jarnuszkiewicz | 123/257 |
| 4,307,687 | 12/1981 | Holstein | 123/59 EC |
| 4,422,430 | 12/1983 | Wiatrak | 123/568 |
| 4,716,877 | 1/1988 | Duret | 123/534 X |

*Primary Examiner*—Willis R. Wolfe

*Attorney, Agent, or Firm*—Michael, Best & Friedrich

[57] ABSTRACT

Disclosed herein is an internal combustion engine comprising first and second cylinders respectively including head ends and side walls, first and second pistons respectively reciprocably movable in the first and second cylinders between top dead center and bottom dead center positions, one of the first and second pistons being adjacent top dead center position when the other of the first and second pistons is adjacent bottom dead center position, a fuel supply venturi extending between the cylinders and including a throat, and a fuel injector located adjacent the head ends of the first and second cylinders, communicating with the throat, and including a valve movable between a closed position and an open position affording fuel flow into the throat.

26 Claims, 2 Drawing Sheets

FUEL INJECTION SYSTEM FOR MULTI CYLINDER TWO-STROKE ENGINE

BACKGROUND OF THE INVENTION

The invention relates generally to internal combustion engines. More particularly, the invention relates to oppositely acting two-cylinder, two-stroke internal combustion engines, and to such engines which are particularly adapted for use in marine propulsion devices, such as outboard motors.

The invention also relates to fuel supply systems for such engines, and, more particularly, to fuel injection systems for such engines.

The invention is directed to reducing or eliminating fuel loss due to over scavaging of air/fuel mixture in a two-stroke engine. To accomplish this goal requires good atomization of the injected fuel, as well as proper timing and duration of the fuel delivery.

Attention is directed to the following U.S. Patents:

| U.S. Pat. Nos. | | |
|---|---|---|
| 1,394,850 | A. R. Long | October 25, 1921 |
| 1,860,784 | R. E. Nelson | May 31, 1932 |
| 1,921,510 | W. De Wasmundt | August 8, 1933 |
| 2,528,263 | C. W Chapman | October 31, 1950 |
| 4,033,302 | S. Jarnuszkiewicz | July 5, 1977 |
| 4,131,090 | S. Jarnuszkiewicz | December 26, 1978 |
| 4,307,687 | E. Holstein | December 29, 1981 |
| 4,422,430 | W. Wiatrak | December 27, 1983 |

Attention is also drawn to German Patent 372,807.

SUMMARY OF THE INVENTION

The invention provides an internal combustion engine comprising first and second cylinders respectively including head ends, first and second pistons respectively reciprocably movable in the first and second cylinders between top dead center and bottom dead center positions and being out-of-phase with each other, a fuel supply venturi extending between the cylinders and including a throat, and a fuel injector located adjacent the head ends of the first and second cylinders, communicating with the throat, and including a valve movable between a closed position and an open position affording fuel flow into the throat.

The invention also provides an internal combustion engine comprising a cylinder block including first and second side walls respectively defining first and second cylinders, a cylinder head secured to the cylinder block and defining first and second cylinder head ends respectively associated with the first and second cylinders, first and second pistons respectively reciprocably movable in the first and second cylinders between top dead center and bottom dead center positions and being out-of-phase with each other, a gas conduit extending between the first and second cylinders and including a central portion and opposite first and second end portions communicating with the central portion and respectively with the first and second cylinders in the area thereof above the pistons when the pistons are in top dead center positions, which end portions are located in one of the cylinder block and the cylinder head, and a fuel injector located adjacent the head ends of the first and second cylinders, communicating with the central portion of the gas conduit and including a valve movable between a closed position and an open position affording fuel flow into the central portion of the gas conduit.

The invention also provides an internal combustion engine comprising a cylinder block including first and second side walls respectively defining first and second cylinders, a cylinder head secured to the cylinder block and defining first and second cylinder head ends respectively associated with the first and second cylinders, first and second pistons respectively reciprocably movable in the first and second cylinders between top dead center and bottom dead center positions, one of the first and second pistons being adjacent top dead center position when the other of the first and second pistons is adjacent bottom dead center position, a gas venturi conduit extending between the first and second cylinders and including a throat having opposite first and second ends, said gas venturi conduit also including first and second passages respectively extending from said first and second ends of said throat and respectively communicating with said first and second cylinders in the area thereof above said pistons when said pistons are in top dead center positions, each of said first and second passages including an end portion which is located in one of said cylinder block and said cylinder head, which is of generally uniform cross sectional area, and which communicates with the associated one of said first and second cylinders, and a divergent portion having a smaller end communicating with the associated one of said first and second ends of said throat, and a larger end communicating with the associated one of said end portions, and a fuel injector located in the one of the cylinder head and the cylinder block, communicating with said throat of said gas venturi conduit, and including a valve movable between a closed position and an open position affording fuel flow into said throat of said gas venturi conduit.

The invention also provides an internal combustion engine comprising first and second cylinders, first and second pistons respectively reciprocably movable in the first and second cylinders between top dead center and bottom dead center positions and being out-of-phase with each other, a gas passageway extending between the cylinders and including a throat, and a fuel injector including a fuel supply passage communicating with the throat, and a valve movable between a closed position preventing gas flow through the gas passageway between the cylinders and preventing fuel flow from the fuel supply passage into the throat, and an open position affording gas flow through the gas passageway between the cylinders and affording fuel flow from the fuel supply passage into the throat.

Other features and advantages of the invention will become apparent to those skilled in the art upon review of the following detailed description, claims and drawings.

THE DRAWINGS

Figure 1:
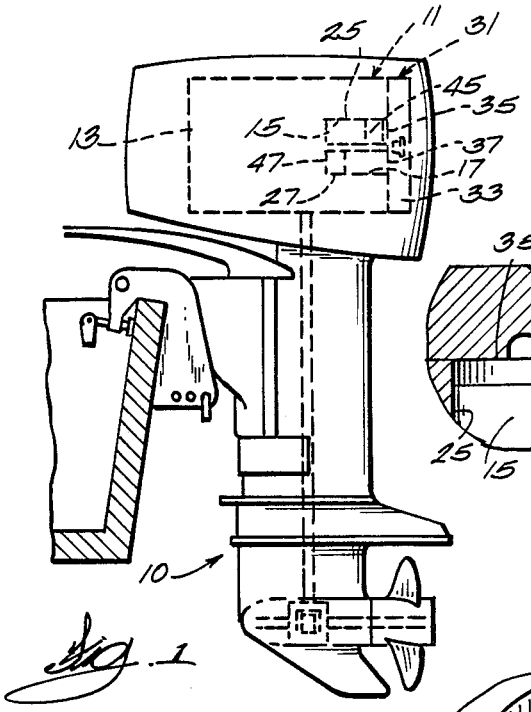
FIG. 1 is a side elevational view of a marine propulsion device in the form of an outboard motor which includes a two-stroke internal combustion engine embodying various of the features of the invention.
Figure 2:
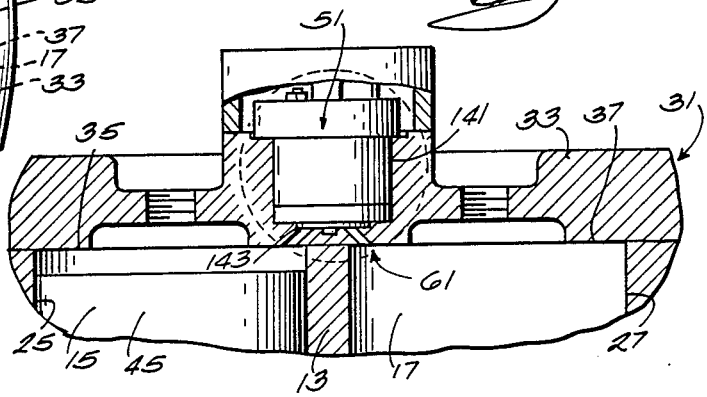
FIG. 2 is an enlarged view partially in section and taken along line 2—2 of FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is marine propulsion device 10 including an internal combustion engine 11 comprising a cylinder block 13 including a pair of cylinders 15 and 17 respectively including side walls 25 and 27. Secured to the cylinder block 13 to provide an engine block assembly 31 is a cylinder head 33 which provides respective cylinder head ends 35 and 37.

Respectively located in the first and second cylinders 15 and 17 are first and second pistons 45 and 47 which are reciprocably movable between bottom dead center positions and top dead center positions in adjacently spaced relation to the cylinder head ends 35 and 37. The pistons 45 and 47 are connected to each other so as to be oppositely acting, i.e., one of the pistons 45 and 47 is adjacent top dead center when the other of the pistons 45 and 47 is adjacent bottom dead center.

Fuel is supplied to the first and second cylinders 15 and 17 by a fuel supply arrangement including single fuel injector 51 which is communicable with a fuel supply passageway or conduit 61 which which is in the form of a venturi, which extends between the cylinders 15 and 17, and which communicates with the cylinders 15 and 17 either through the head ends 35 and 37 (as shown in the drawings), or through the side walls 25 and 27 in the area above the pistons 45 and 47 when the pistons are in top dead center position. The fuel injector 51 preferably is electronically operated to meter the fuel and to control injection timing and duration. Location of the fuel injector in the cylinder head 33 is preferred because of compactness and ease of manufacture and installation.

Any suitable electro-mechanical injector, preferably a low pressure injector, can be employed to supply fuel to the fuel supply venturi 61. More specifically, the fuel supply passageway 61 includes a throat or central portion 63 having a minimum cross sectional area as compared to the remainder of the fuel supply passageway 61.

Communicating with the throat 61 is a fuel supply or inlet port 65 which forms part of a fuel supply bore or passage 69 in the fuel injector 51 and which communicates with a conical valve seat 67 converging in the direction away from the throat 63 and also forming a part of the fuel supply bore 69.

Located in the fuel supply bore 69 is a valve member 71 which is biased upwardly to a closed position by a suitable spring 72 and which is movable downwardly to an open position by action of a solenoid coil 74. The valve member 71 includes a stem 73 movable through the fuel supply bore 69 and a conical valve head 75 which, in response to reciprocation in the direction of the stem 73, is movable between the open position in which the valve head 75 is spaced from the valve seat 67, and the closed position in which the valve head 75 engages the valve seat 67 to close the fuel supply port 65.

Fuel under pressure is supplied to the area in the fuel supply bore 67 in encircling relation to the stem 73 for injection through the inlet port 65 into the throat 63 when the valve member 71 is moved to the open position. As a consequence, the fuel entering the throat 63 is in the form of a diverging conical spray.

While other constructions could be employed, in the disclosed construction, the throat 63 is generally a short passageway of generally uniform cross sectional area having a width greater than the diameter of the inlet port 65, having a length greater than the width, and having a relatively small height. The venturi throat 63 has opposite ends 85 and 87 which communicate with first and second fuel passages 95 and 97 which extend to, and in communication with, the first and second cylinders 15 and 17, either through the cylinder head ends 35 and 37, or through the cylinder side walls 25 and 27, at locations above the positions of the pistons 45 and 47 when at top dead center.

In the construction shown in FIG. 1, the fuel passages 95 and 97 extend along respective axes 105 and 107 and include respective cylindrical end portions 115 and 117 which respectively extend along the axes 105 and 107 and communicate with the associated cylinders 15 and 17, and respective divergent conical portions 125 and 127 which respectively extend along the axes 105 and 107, which, at their inner or smaller ends, respectively communicate with the opposite ends 85 and 87 of the throat 63, and which, at their outer or larger ends, respectively communicate with the cylindrical portions 115 and 117. The ends of the cylindrical portions 115 and 117 communicating with the cylinders 15 and 17 form respective nozzles 135 and 137.

Preferably, the fuel supply venturi 61 is arranged to provide a sonic nozzle. Such a nozzle is obtained in the fuel supply venturi 61 when the pressure difference or ratio between the nozzles 135 and 137 is greater than 2 to 1, i.e., when the pressure at one end of the venturi throat 63 is twice the pressure at the other end. Such a pressure ratio can be obtained when using an area ratio of 4 to 1 between the throat 63 of the fuel supply passageway 61 and the nozzles 135 and 137 respectively communicating with the cylinders 15 and 17. In addition, two cylinders which are out-of-phase at a crankshaft rotational angle other than 180° can be employed so long as there is sufficient pressure difference between the cylinders.

Figure 4:
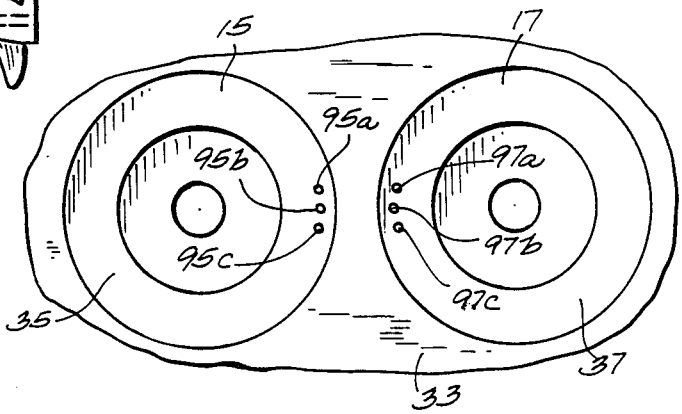
FIG. 4 is a view looking upwardly toward the bottom of FIG. 2 and illustrating a modification.
Figure 3:
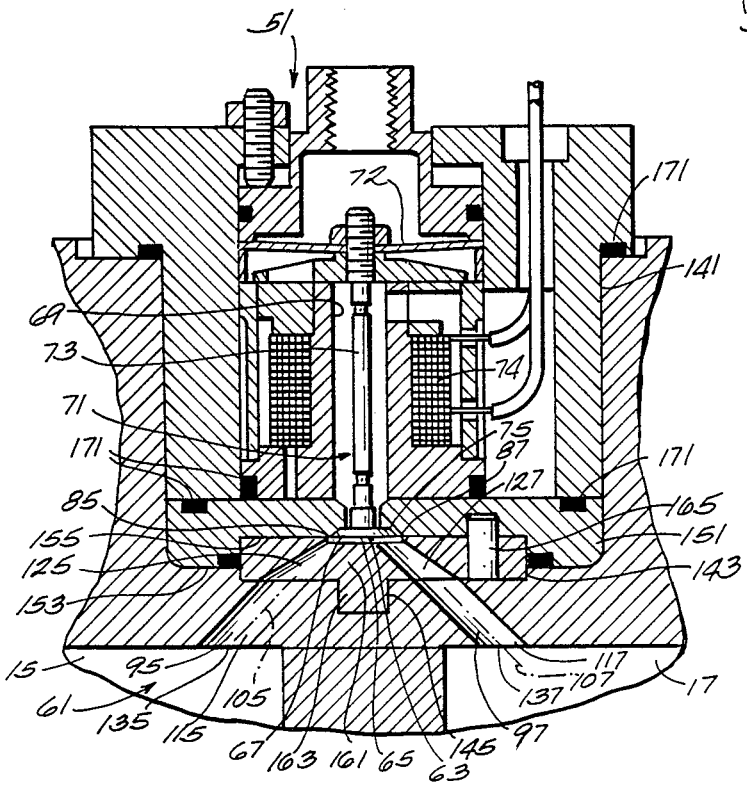
FIG. 3 is an enlarged view of the fuel supply arrangement included in the portion shown in the dotted circle in FIG. 2.

While the construction shown in FIG. 3 includes a single passage between each of the cylinders 15 and 17 and the throat 63, it is preferred to employ, as shown in FIG. 4, three or four sub or smaller passages 95*a*, *b* and *c* and 97*a*, *b*, and *c* which have a total flow area equal to the single passage shown in FIG. 3. The sub-passages include cylindrical and conical passage portions which, when added together, have a flow area comparable to the single gas passageway 61 shown in FIG. 3 and the 4 to 1 area ratio specified above.

Preferably, the sub-passages 95*a*, *b*, and *c*, and 97*a*, *b*, and *c*, are arranged as shown generally in FIG. 4, in an angular array so as to provide a fan shaped spray in the cylinders 15 and 17.

In order to achieve the structure disclosed above, the cylinder head 33 includes a cylindrical recess 141 having, at the inner end thereof, a first counter bore 143 and having inwardly thereof, a pilot bore 145. The fuel injector 51 is received in the recess 141 and can be secured to the cylinder head 33 by any suitable means. While other constructions can be employed, the fuel injector 51 includes a base member or valve disc 151 having, on the undersurface 153 thereof, a recess or pocket 155 which is cylindrical and which, centrally thereof, has an aperture which forms part of the fuel supply bore 69 and which includes the before mentioned valve seat 67 which communicates through the inlet port 65 into the recess or pocket 155. The under surface 153 defines one side or wall of the throat 63.

Located in the recess or pocket 155 is a valve plate 161 which defines the other three sides of the venturi throat 63 and in which the divergent portions 125 and 127 of the fuel passages 95 and 97 are provided.

The valve plate 161 is provided with a pilot stub shaft 163 which is received in the pilot bore 145 to provide alignment. In addition, the valve plate 161 and the valve disc 151 can be keyed together by one or more pins 165, or otherwise suitably secured together.

Suitable gaskets or seals 171 can be employed as indicated.

The cylindrical portions 115 and 117 of the fuel passages 95 and 97 are provided by cylindrical bores in the cylinder head 33 or by cylindrical bores formed in the cylinder block 13. If the cylindrical passage portions 115 and 117 are located in the cylinder block 13, the recess which receives the fuel injection 51 can be located on the side of the cylinder block 13, rather than in the exterior face of the cylinder head 33.

With the disclosed construction, the high pressure in one of the cylinders 15 and 17 is employed to deliver fuel from the throat 63 into the other of the cylinders 15 and 17. The before mentioned pressure ratio and area ratio are effective, in conjunction with the fuel supply venturi 61, and with fuel supply to the throat 63, to provide a sonic nozzle which affords prevention of flow separation and results in a steady, well dispersed, fine droplet spray. The high pressure existing in one cylinder after compression or combustion, forces fuel through the throat 63, breaking the fuel to finely atomized fuel droplets and supplying the other cylinder with a uniform fuel/gas spray.

In the construction shown in FIG. 3, when the valve member 71 is in the open position, as shown in FIG. 3, the gas flow between the cylinders 15 and 17 is located below the valve head 75.

Figure 5:
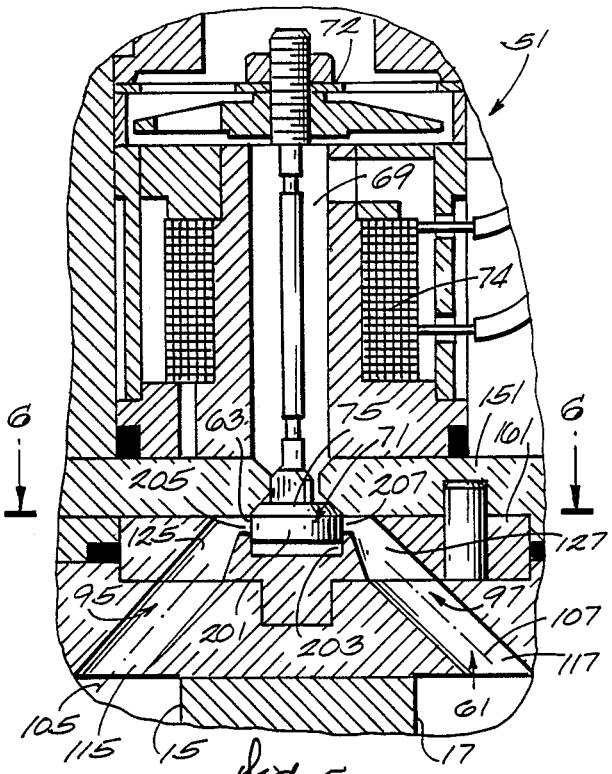
FIG. 5 is an enlarged view of a modified fuel supply arrangement.
Figure 6:
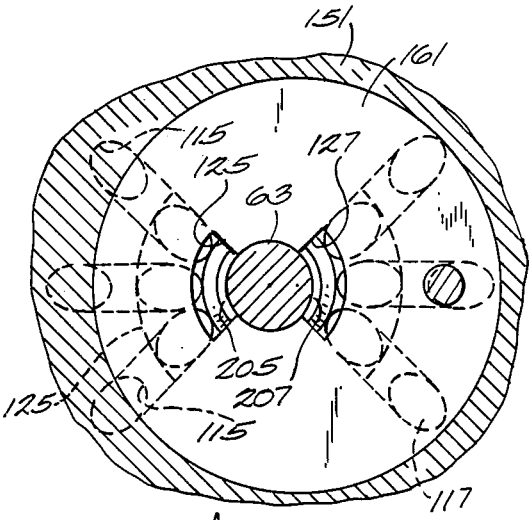
FIG. 6 is a view taken along line 6—6 of FIG. 5.

Shown in FIGS. 5 and 6 is another embodiment of a fuel supply arrangement which includes components which are similiar to components which have been disclosed in connection with the construction shown in FIG. 3 and to which the same reference numerals have been applied. More particularly, the construction shown in FIGS. 5 and 6 comprises a gas passageway 61 which extends between two cylinders 15 and 17 and includes a throat 63, and a fuel injector 51 which includes a fuel supply passage or bore 69 communicating with the throat 63 and a valve member 71 movable between a closed position preventing fuel flow from the fuel injector 51 into the throat 63 and an open position permitting such flow. The arrangement shown in FIGS. 5 and 6 differs from the arrangement shown in FIG. 3 in that the valve member 71 also serves, when in the closed position, to prevent gas flow through the gas passageway 61 between the cylinders 15 and 17, and, when in the open position, to permit such flow.

While other constructions can be employed, in the construction shown in FIGS. 5 and 6, the fuel injector 51 includes means in the form of a suitable spring 72 which biases the valve member 71 upwardly to the closed position and a solenoid coil 74 which, when electrically energized, acts to displace the valve member 71 downwardly to the open position. In this regard, the valve disk 151 and the valve member 71 are constructed in a generally identical manner as has been disclosed with respect to FIG. 3, except that the valve member 71 additionally includes a downwardly projecting cylindrical extension or portion 201 which is adapted to extend across the throat 63 to close the throat 63 when the valve member 71 is in the closed position. In addition, the construction of the valve ports 161 shown in FIGS. 5 and 6, differs from the construction shown in FIG. 3 in that the conical, divergent passage portions 125 and 127 of the gas passageway 61 in the valve plate 161 shown in FIG. 3 have been unified into fan shaped passage portions 125 and 127. Specifically, as shown in FIGS. 5 and 6, the central portion or throat 63 of the gas passageway 61 is of circular shape, receives the cylindrical portion 201 of the valve member 71 in sealing engagement when the valve member is in the closed position, and communicates with a similarly shaped recess or well 203 which receives the cylindrical portion 201 of the valve member 71 when the valve member 71 is in the open position. Any suitable means can be provided to vent the well 203 in response to movement of the cylindrical portion 201 thereinto.

The gas passageway 61 in the valve plate 161 also includes, on each side of the cylindrical portion or throat 63, the fan shaped passage portions 125 and 127 which, at their inner ends, connect through respective necks 205 and 207 with the throat 63, and which, at their outer ends, respectively communicate with respective arrays of angularly spaced cylindrical passageway portions 115 and 117 in the cylinder block 13.

In the construction shown in FIGS. 5 and 6, when the valve member 71 is in the open position, the gas flow between the cylinders 15 and 17 is, around the conical portion of the valve head 75.

Figure 7:
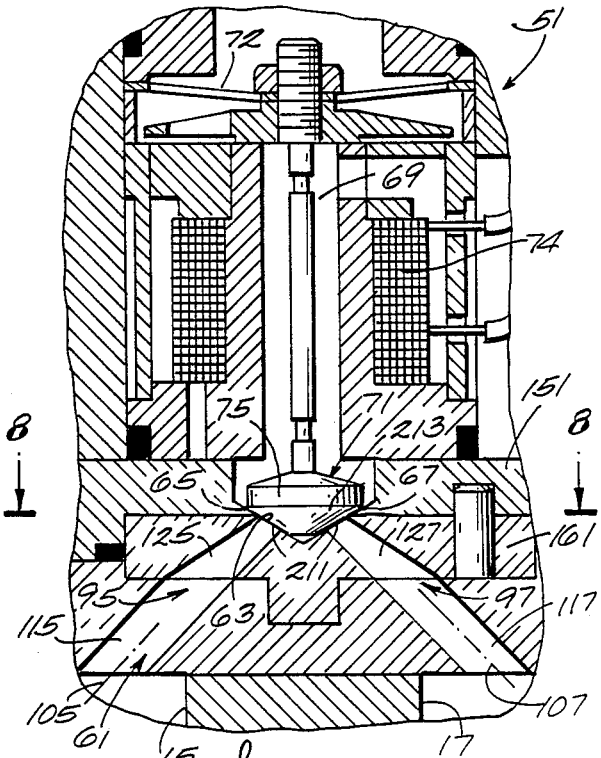
FIG. 7 is an enlarged view of another modified fuel supply arrangement.
Figure 8:
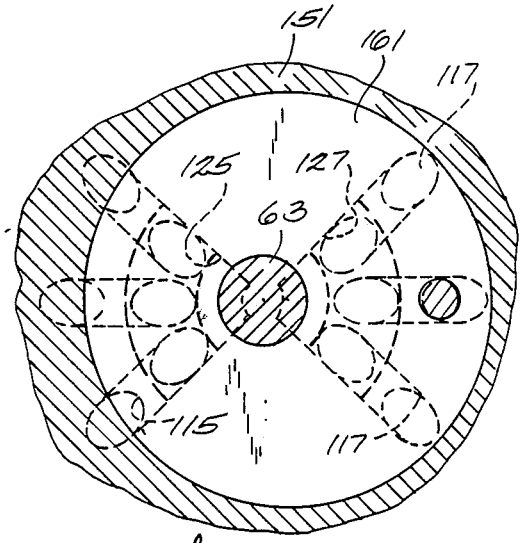
FIG. 8 is a view taken along line 8—8 of FIG. 7.

Shown in FIGS. 7 and 8 is still another embodiment of a fuel supply arrangement in which the valve member 71 is movable between a closed position which prevents fuel flow from the injector 51 and which additionally prevents gas flow through the gas passageway 61 between the cylinders 15 and 17 and which, when in the open position, permits fuel flow from the fuel injector 51 into the throat 63 and gas flow through the gas passageway 61 between the cylinders 15 and 17. In this regard, the components which are included in the arrangement shown in FIGS. 7 and 8 and which are similar to the components shown in FIGS. 3, 5, and 6, are identified by the same reference numerals which have been employed with respect to the embodiments shown in FIGS. 3, 5, and 6.

In the construction shown in FIGS. 7 and 8, the valve member 71 is biased downwardly to the closed position by a suitable spring 72 and is displaceable upwardly to the open position by the action of a solenoid coil 74 in response to energization thereof. The valve member 71, the valve disk 151, and the valve plate 161 have been modified to afford the desired action. More particularly, in the construction shown in FIGS. 7 and 8, the fuel supply bore or passage 69 includes, in the valve disk 151, a conical valve seat 67 which converges toward the fuel supply and inlet port 65.

In addition, the valve plate includes fan inner ends, terminate or open into a conical valve seat 211 which downwardly converges and which is aligned with and forms a continuation of the conical valve seat 67 formed in the valve disk 151. At their outer ends, the fan shaped passage portions 125 and 127 respectively communicate with respective arrays of angularly spaced cylindrical passage portions 115 and 117 in the cylinder block 13.

Still further in addition, the valve head 75 includes a lower conically shaped portion including a downwardly converging valve surface 213 which, when the valve member 71 is in the closed position, engages the conical valve seats 67 and 211 to respectively close the fuel supply bore or passage 69 and the gas passageway 61. When the solenoid 74 is electrically actuated, the valve member 71 moves upwardly, i.e., away from the valve seats 67 and 211, thereby opening the fuel supply bore or passage 69 and the gas passageway 61.

In the constructions shown in FIGS. 5 through 8, the pressure of the fuel discharged by the fuel injector 51 into the gas passageway 61 is greater than the pressure of the gas flowing through the gas passageway 61. In this regard, reduction in pressure in the gas passageway 61 can be obtained by employing the passage portion array which is shown in FIGS. 6 and 8 and which, in effect, provide a gas passageway 61 of increased size. However, it is noted that the area of the gas passages, on each side of the throat 63, is a small percentage of the displacement volume of the cylinders 25 and 27, and thus does not materially affect the power output of the engine.

In the construction shown in FIGS. 7 and 8, when the valve member 71 is in the open position, the gas flow between the cylinders 15 and 17 is around the lower conical portion of the valve head 75.

In the constructions shown in FIGS. 5 through 8, the valve member 71 controls the timing and duration of the gas flow between the cylinders 15 and 17 and the fuel injection. In these embodiments, the fuel is at a greater pressure than the pressure in the throat 63 at the time of fuel injection.

It is contemplated that the gas flowing in the passageway 61 will be either combustion air, or combustion products, or a combination thereof.

As a consequence of employing electro-mechanical fuel delivery and the use of the fuel supply venturi 63 disclosed above, the arrangements disclosed hereinabove serve to reduce fuel consumption and to reduce hydrocarbon exhaust in a two-stroke engine to a level approaching the fuel consumption and hydrocarbon exhaust from uncontrolled four-stroke engines.

Various of the features of the invention are set forth in the following claims.

I claim:

1. An internal combustion engine comprising first and second cylinders respectively including head ends, first and second pistons respectively reciprocably movable in said first and second cylinders between top dead center and bottom dead center positions and being out-of-phase with each other, a fuel supply venturi extending between said cylinders and including a throat having spaced first and second ends, and a fuel injector located adjacent said head ends of said first and second cylinders, communicating with said throat between said ends, and including a valve movable between a closed position and an open position affording fuel flow into said throat.

2. An internal combustion engine comprising first and second cylinders respectively including head ends, first and second pistons respectively reciprocably movable in said first and second cylinders between top dead center and bottom dead center positions and being out-of-phase with each other, a fuel supply venturi extending between said cylinders and including a throat, having opposite first and second ends, and first and second passages respectively extending from said first and second ends of said throat and communicating with said first and second cylinders, each of said first and second passages including an end portion which is of generally uniform cross-sectional area and which communicates with the associated one of said first and second cylinders, and a divergent portion having a larger end communicating with the associated one of said ends portions of uniform cross-sectional area, and a fuel injector located adjacent said head ends of said first and second cylinders, communicating with said throat, and including a valve movable between a closed position and an open position affording fuel flow into said throat.

3. An internal combustion engine in accordance with claim 2 and further including a cylinder head including said cylinder head ends, and a cylinder block including said cylinder side walls, and wherein said cylinder head and cylinder block are secured together to form an engine block assembly, and wherein said end portions are located in said engine block assembly.

4. An internal combustion engine in accordance with claim 3 wherein said end passages are located in one of said cylinder head and said cylinder block.

5. An internal combustion engine in accordance with claim 3 wherein said engine block assembly includes a recess and wherein said fuel injector is located in said recess.

6. An internal combustion engine in accordance with claim 2 wherein said throat has a cross-sectional area and wherein the ratio of said cross-sectional areas of said end portions to said cross-sectional area of said throat is at least about 4 to 1.

7. An internal combustion engine in accordance with claim 3 wherein said fuel injector includes a fuel supply bore including a conical valve seat which diverges toward said throat, and a valve member extending in said fuel supply bore and including a conical valve head having a divergent surface engagable with said valve seat.

8. An internal combustion engine in accordance with claim 7 wherein said fuel injector comprises a capsule including a base member having therein a pocket with a surface transverse to said fuel bore, and wherein said fuel supply bore communicates with said pocket through said surface, and further including a valve plate received in said pocket and cooperating with said transverse surface to define said throat, said valve plate also including therein said divergent fuel passage portions.

9. An internal combustion engine comprising a cylinder block including first and second side walls respectively defining first and second cylinders, a cylinder head secured to said cylinder block and defining first and second cylinder head ends respectively associated with said first and second cylinders, first and second pistons respectively reciprocably movable in said first and second cylinders between top dead center and bottom dead center positions and being out-of-phase with each other, a gas conduit extending between said first and second cylinders and including a central portion and opposite first and second end portions communicating with said central portion and respectively with said first and second cylinders in the area thereof above said pistons when said pistons are in top dead center positions, said end portions being located in one of said cylinder block and said cylinder head, and a fuel injector located adjacent said head ends of said first and second cylinders, communicating with said central portion of said gas conduit and including a valve movable between a closed position and an open position affording fuel flow into said central portion of said gas conduit.

10. An internal combustion engine in accordance with claim 9 wherein said fuel injector is located in said one of said cylinder head and said cylinder block.

11. An internal combustion engine comprising a cylinder block including first and second side walls respectively defining first and second cylinders, a cylinder head secured to said cylinder block and defining first and second cylinder head ends respectively associated with said first and second cylinders, first and second pistons respectively reciprocably movable in said first and second cylinders between top dead center and bottom dead center positions, one of said first and second pistons being adjacent top dead center position when the other of said first and second pistons is adjacent bottom dead center position, a gas venturi conduit extending between said first and second cylinders and including a throat having opposite first and second ends, said gas venturi conduit also including first and second passages respectively extending from said first and second ends of said throat and respectively communicating with said first and second cylinders in the area thereof above said pistons when said pistons are in top dead center positions, each of said first and second passages including an end portion which is located in one of said cylinder block and said cylinder head, which is of generally uniform cross sectional area, and which communicates with the associated one of said first and second cylinders, and a divergent portion having a smaller end communicating with the associated one of said first and second ends of said throat, and a larger end communicating with the associated one of said end portions, and a fuel injector located in said one of said cylinder head and said cylinder block, communicating with said throat of said gas venturi conduit, and including a valve movable between a closed position and an open position affording fuel flow into said throat of said gas venturi conduit.

12. An internal combustion engine in accordance with claim 11 wherein said cylinder block and said cylinder head form an engine block assembly, and wherein said engine block assembly includes a recess, and wherein said fuel injector is located in said recess.

13. An internal combustion engine in accordance with claim 11 wherein said fuel injector includes a fuel supply bore including a conical valve seat which diverges toward said throat, and a valve member extending in said fuel supply bore and including a conical valve head having a divergent surface engagable with said valve seat.

14. An internal combustion engine in accordance with claim 13 wherein said fuel injector comprises a capsule including a base member having therein a pocket with a surface transverse to said fuel bore, and wherein said fuel supply bore communicates with said pocket through said surface, and further including a valve plate received in said pocket and cooperating with said transverse surface to define said throat, said valve plate also including therein said divergent fuel passage portions.

15. An internal combustion engine comprising first and second cylinders, first and second pistons respectively reciprocably movable in said first and second cylinders between top dead center and bottom dead center positions and being out-of-phase with each other, a gas passageway extending between said cylinders and including a throat, and a fuel injector including a fuel supply passage communicating with said throat, and a valve movable between a closed position preventing gas flow through said gas passageway between said cylinders and preventing fuel flow from said fuel supply passage into said throat and an open position affording gas flow through said gas passageway between said cylinders and affording fuel flow from said fuel supply passage into said throat.

16. An internal combustion engine in accordance with claim 15 wherein said fuel injector includes a fuel supply passage including a conical valve seat which diverges toward said throat, wherein said throat includes a cylindrical valve seat, and wherein said fuel injector includes a valve member extending in said fuel supply bore and including a valve head having a divergent conical surface engagable with said valve seats of said fuel supply passage and said throat.

17. An internal combustion engine in accordance with claim 16 wherein said fuel injector comprises a capsule including a base member having therein a pocket with a surface transverse to said fuel bore, and wheein said fuel supply passage communicates with said pocket through said surface, and further including a valve plate received in said pocket and cooperating with said transverse surface to define said throat, said valve plate also including therein divergent fuel passage portions communicating with said throat.

18. An internal combustion engine in accordance with claim 15 wherein said fuel injector includes a fuel supply passage including a conical valve seat which converges toward said throat, wherein said throat includes a conical valve seat which coverges in the direction away from said valve seat in said fuel supply passage, and wherein said fuel injector includes a valve member extending in said fuel supply bore and including a valve head having a conical valve surface engagable with said valve seats of said fuel supply passage and said throat.

19. An internal combustion engine in accordance with claim 18 wherein said fuel injector comprises a capsule including a base member having therein a pocket with a surface transverse to said fuel bore, and wherein said fuel supply passage communicates with said pocket through said surface, and further including a valve plate received in said pocket and cooperating with said transverse surface to define said throat, said valve plate also including therein divergent fuel passage portions communicating with said throat.

20. An internal combustion engine in accordance with claim 15 wherein said throat includes opposite first and second ends, and wherein said fuel supply passage includes first and second passages respectively extending from said first and second ends of said throat and communicating with said first and second cylinders, each of said first and second passages including an end portion which is of generally uniform cross-sectional area and which communicates with the associated one of said first and second cylinders, and a divergent portion having a smaller end communicating with the associated one of said first and second ends of said throat, and a larger end communicating with the said associated one of said ends portions of uniform cross-sectional area.

21. An internal combustion engine in accordance with claim 20 and further including a cylinder head including said cylinder head ends, and a cylinder block including said cylinder side walls, and wherein said cylinder head and cylinder block are secured together to form an engine block assembly, and wherein said end portions are located in said engine block assembly.

22. An internal combustion engine in accordance with claim 21 wherein said end passages are located in one of said cylinder head and said cylinder block.

23. An internal combustion engine in accordance with claim 22 wherein said engine block assembly includes a recess and wherein said fuel injector is located in said recess.

24. An internal combustion engine in accordance with claim 20 wherein said throat has a cross-sectional area and wherein the ratio of said cross-sectional areas of said end portions to said cross-sectional area of said throat is at least about 4 to 1.

25. An internal combustion engine in accordance with claim 21 wherein said fuel injector includes a fuel supply bore including a conical valve seat which diverges toward said throat, and a valve member extending in said fuel supply bore and including a conical valve head having a divergent surface engagable with said valve seat.

26. An internal combustion engine in accordance with claim 25 wherein said fuel injector comprises a capsule including a base member having therein a pocket with a surface transverse to said fuel bore, and wherein said fuel supply bore communicates with said pocket through said surface, and further including a valve plate received in said pocket and cooperating with said transverse surface to define said throat, said valve plate also including therein said divergent fuel passage portions.

* * * * *